US007470853B2

(12) United States Patent
Yamane

(10) Patent No.: US 7,470,853 B2
(45) Date of Patent: Dec. 30, 2008

(54) MUSICAL COMPOSITION PROCESSING DEVICE

(75) Inventor: Hiroaki Yamane, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 11/791,523

(22) PCT Filed: Dec. 5, 2005

(86) PCT No.: PCT/JP2005/022303

§ 371 (c)(1),
(2), (4) Date: May 24, 2007

(87) PCT Pub. No.: WO2006/062064

PCT Pub. Date: Jun. 15, 2006

(65) Prior Publication Data

US 2008/0011148 A1 Jan. 17, 2008

(30) Foreign Application Priority Data

Dec. 10, 2004 (JP) ..... 2004-359151

(51) Int. Cl.
*G10H 7/00* (2006.01)

(52) U.S. Cl. ..... 84/616

(58) Field of Classification Search ..... 84/609, 84/619, 616, 654
See application file for complete search history.

(56) References Cited

U.S. PATENT DOCUMENTS 5,038,658 A 8/1991 Tsuruta et al.
5,418,322 A 5/1995 Minamitaka
5,753,843 A * 5/1998 Fay ..... 84/609
5,939,654 A 8/1999 Anada

FOREIGN PATENT DOCUMENTS

| | | |
|---|---|---|
| EP | 0 331 107 | 9/1989 |
| JP | 01-219634 | 9/1989 |
| JP | 05-108073 | 4/1993 |
| JP | 2 715 816 | 11/1997 |
| JP | 10-105169 | 4/1998 |
| JP | 2004-233965 | 8/2004 |
| WO | 2004/038694 | 5/2004 |

* cited by examiner

*Primary Examiner*—Jeffrey Donels
(74) *Attorney, Agent, or Firm*—Wenderoth, Lind & Ponack, L.L.P.

(57) ABSTRACT

A scale information inputting section receives an input of scale information of a musical composition. Based on the scale information of the musical composition inputted to the scale information inputting section, an appearance probability calculating section calculates appearance probabilities of pitch names included in the scale information for each of the pitch names. A template storing section stores 24 types of previously created templates respectively corresponding to 24 types of keys. Based on an appearance probability distribution of the musical composition calculated by the appearance probability calculating section and each of the templates stored in the template storing section, a load ratio calculating section calculates load ratios respectively corresponding to the templates. A tonal information detecting section detects, as tonal information of the musical composition, information indicating the load ratios calculated by the load ratio calculating section as a set, or information calculated based on the set of the load ratios.

12 Claims, 12 Drawing Sheets

| SELECTED MUSICAL COMPOSITION INFORMATION | SEARCH CONDITION |
|---|---|
| BRIGHT | if (T == Maj) |
| DARK | if (T == Min) |
| HAPPY | if (Rmaj > 0.8) |
| MODERATELY HAPPY | if ((Rmaj >= 0.6) && (Rmaj < 0.8)) |
| NEUTRAL | if ((Rmaj >= 0.4) && (Rmaj < 0.6)) |
| MODERATELY SAD | if ((Rmaj >= 0.2) && (Rmaj < 0.4)) |
| SAD | if (Rmaj < 0.2) |
| ⋮ | ⋮ |

【Fig. 1】
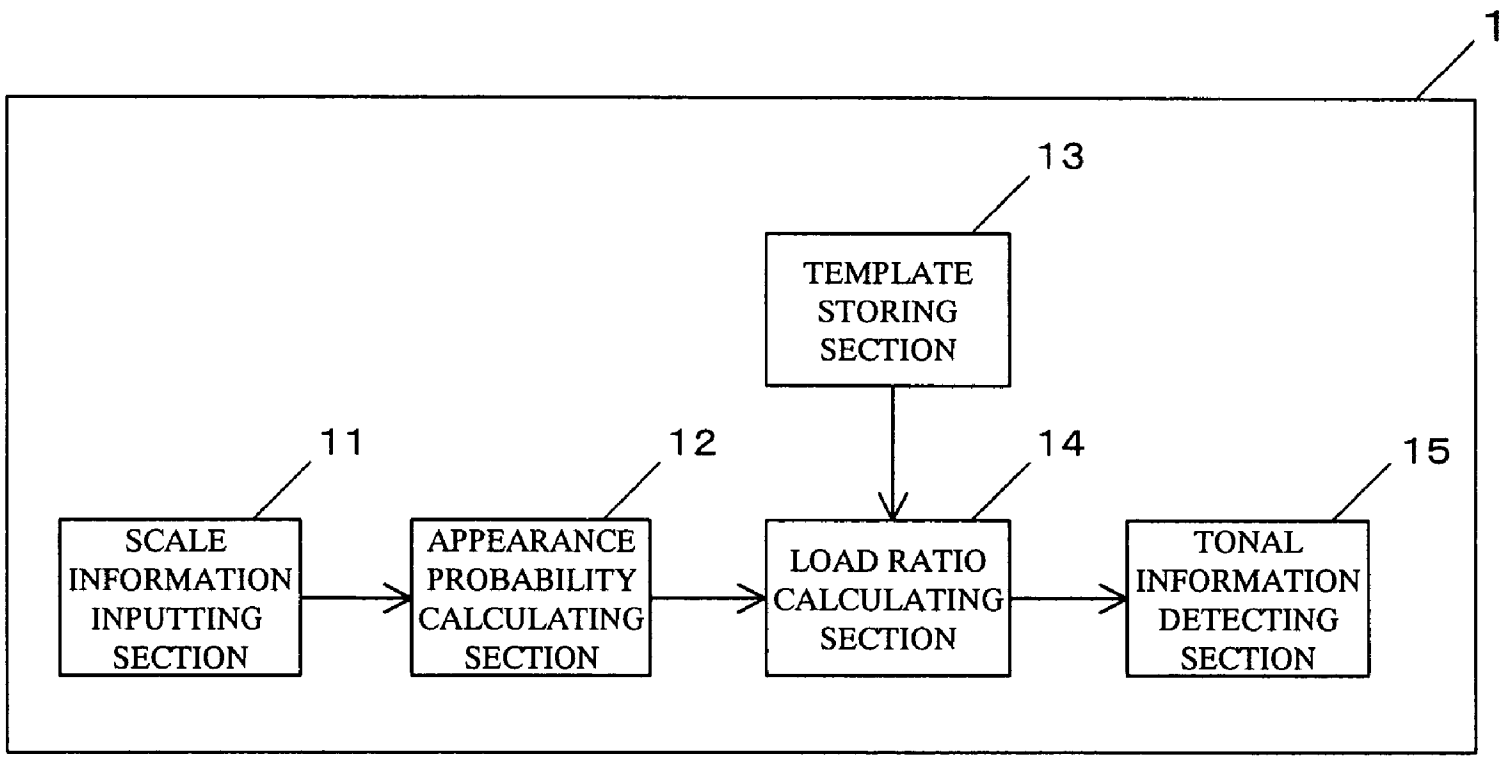

【Fig. 2】

| TIME | NOTE NUMBER | VELOCITY |
|---|---|---|
| 000/0/000 | 60 | 90 |
| 000/0/432 | 60 | 0 |
| 000/0/480 | 57 | 70 |
| 000/0/696 | 57 | 0 |
| 000/1/000 | 62 | 90 |
| ⋮ | ⋮ | ⋮ |

【Fig. 3】
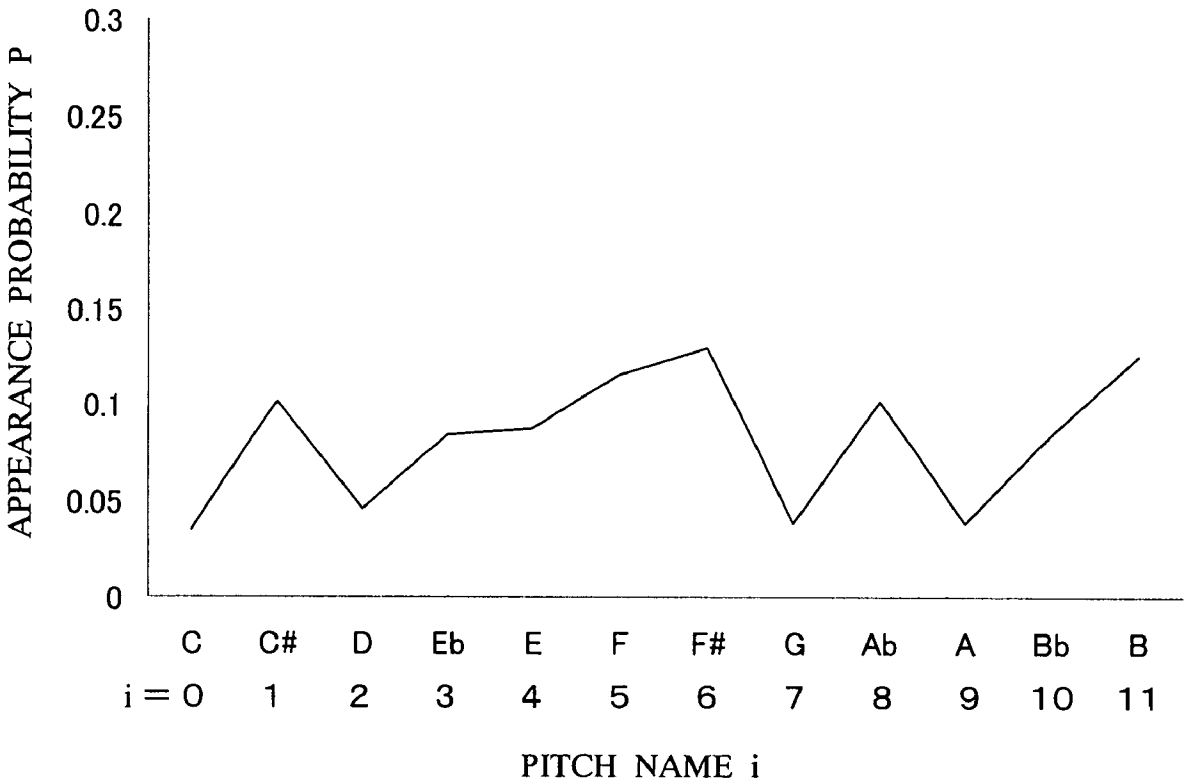

【Fig. 4】
| KEY | KEY NUMBER | TEMPLATE | LOAD RATIO |
|---|---|---|---|
| C | j=0 | 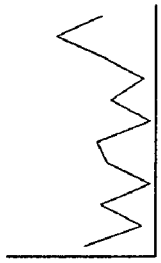 | W(0)=0. 1 |
| D♭ | j=1 | 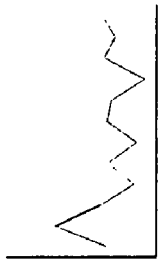 | W(1)=0. 05 |
| ⋮ | ⋮ | ⋮ | ⋮ |
| G♯m | j=23 | 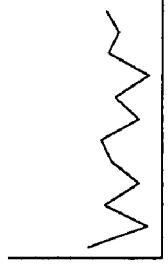 | W(23)=0. 27 |

【Fig. 5】
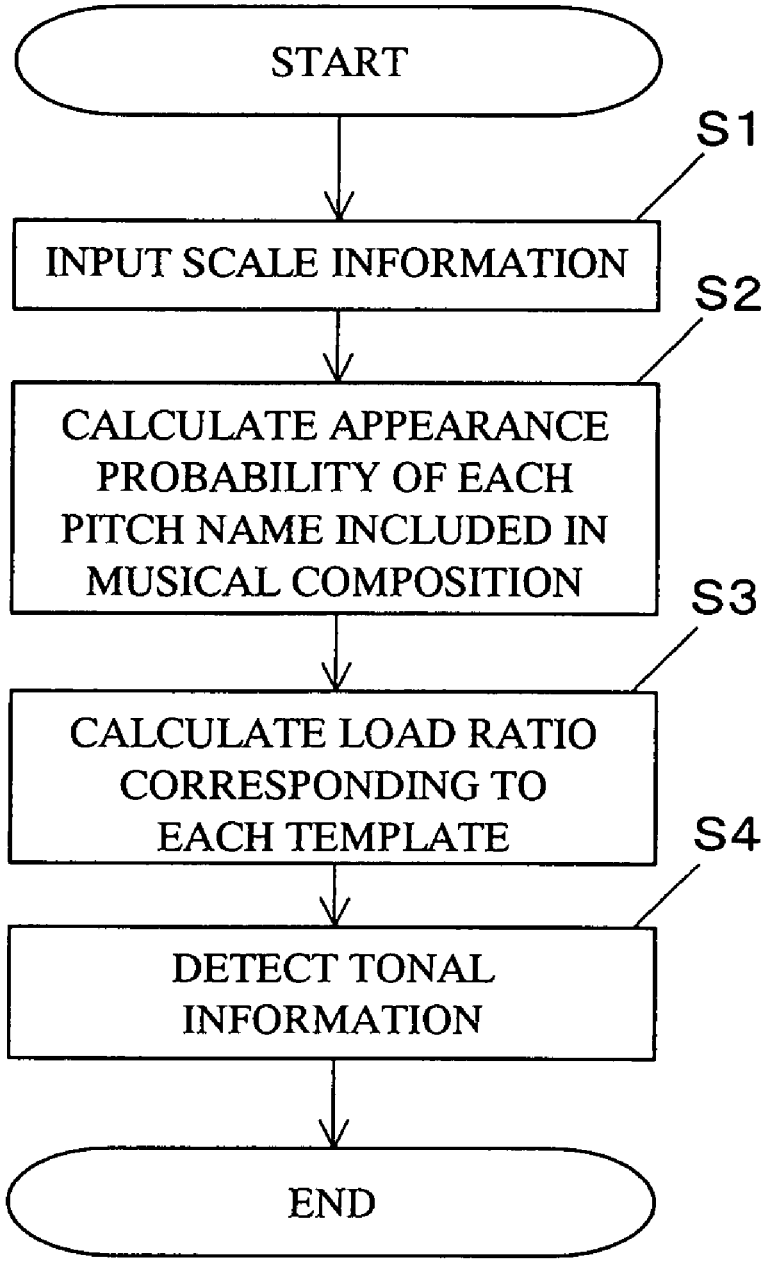

【Fig. 6】

| s=0 | s=1 | s=2 | s=3 | s=4 | s=5 |
|---|---|---|---|---|---|
| C (j=0)<br>Am (j=12) | D♭ (j=1)<br>B♭m (j=13) | D (j=2)<br>Bm (j=14) | E♭ (j=3)<br>Cm (j=15) | E (j=4)<br>C#m (j=16) | F (j=5)<br>Dm (j=17) |
| s=6 | s=7 | s=8 | s=9 | s=10 | s=11 |
| G♭ (j=6)<br>E♭m (j=18) | G (j=7)<br>Em (j=19) | A♭ (j=8)<br>Fm (j=20) | A (j=9)<br>F#m (j=21) | B♭ (j=10)<br>Gm (j=22) | B (j=11)<br>G#m (j=23) |

【Fig. 7】
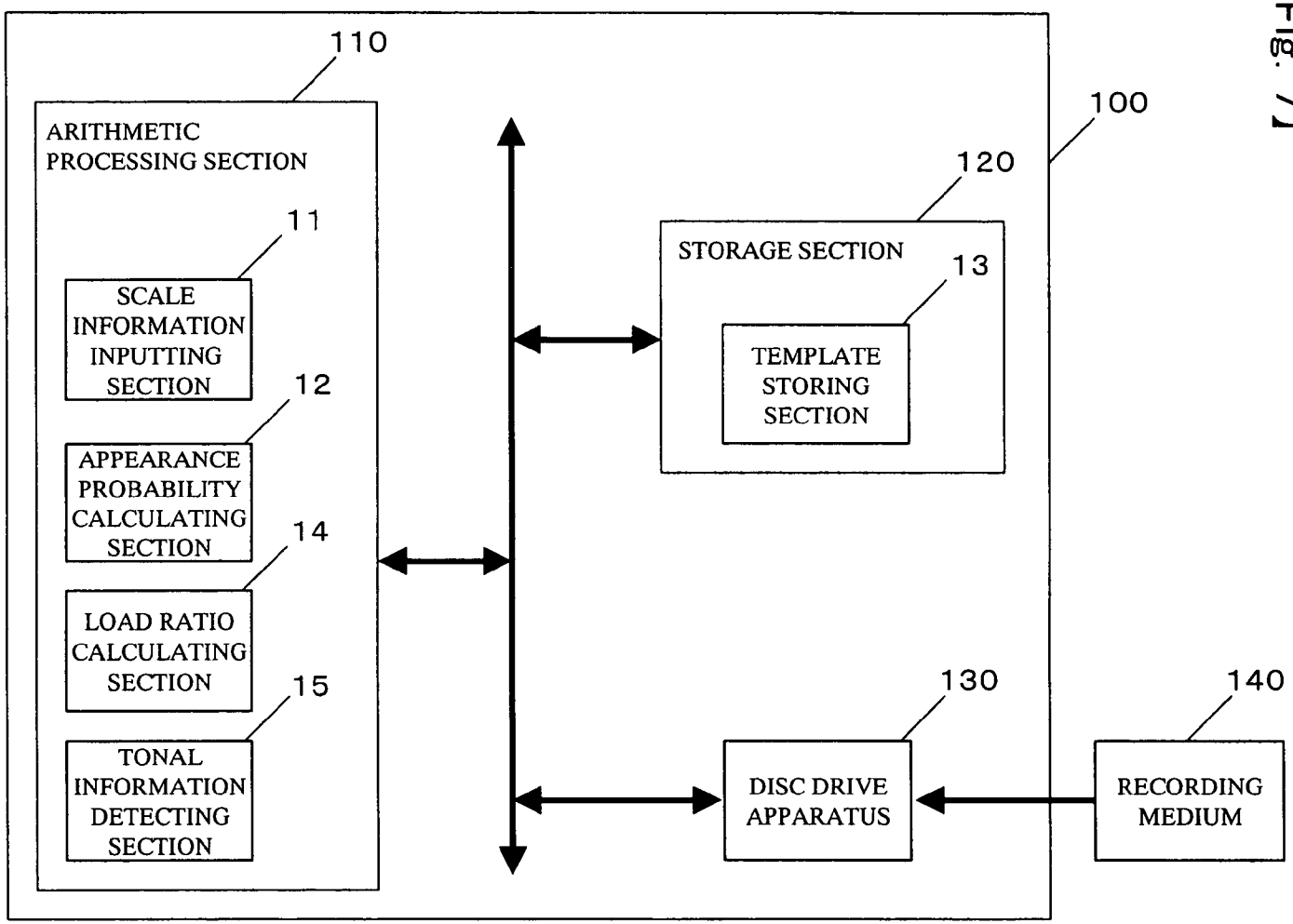

【Fig. 8】
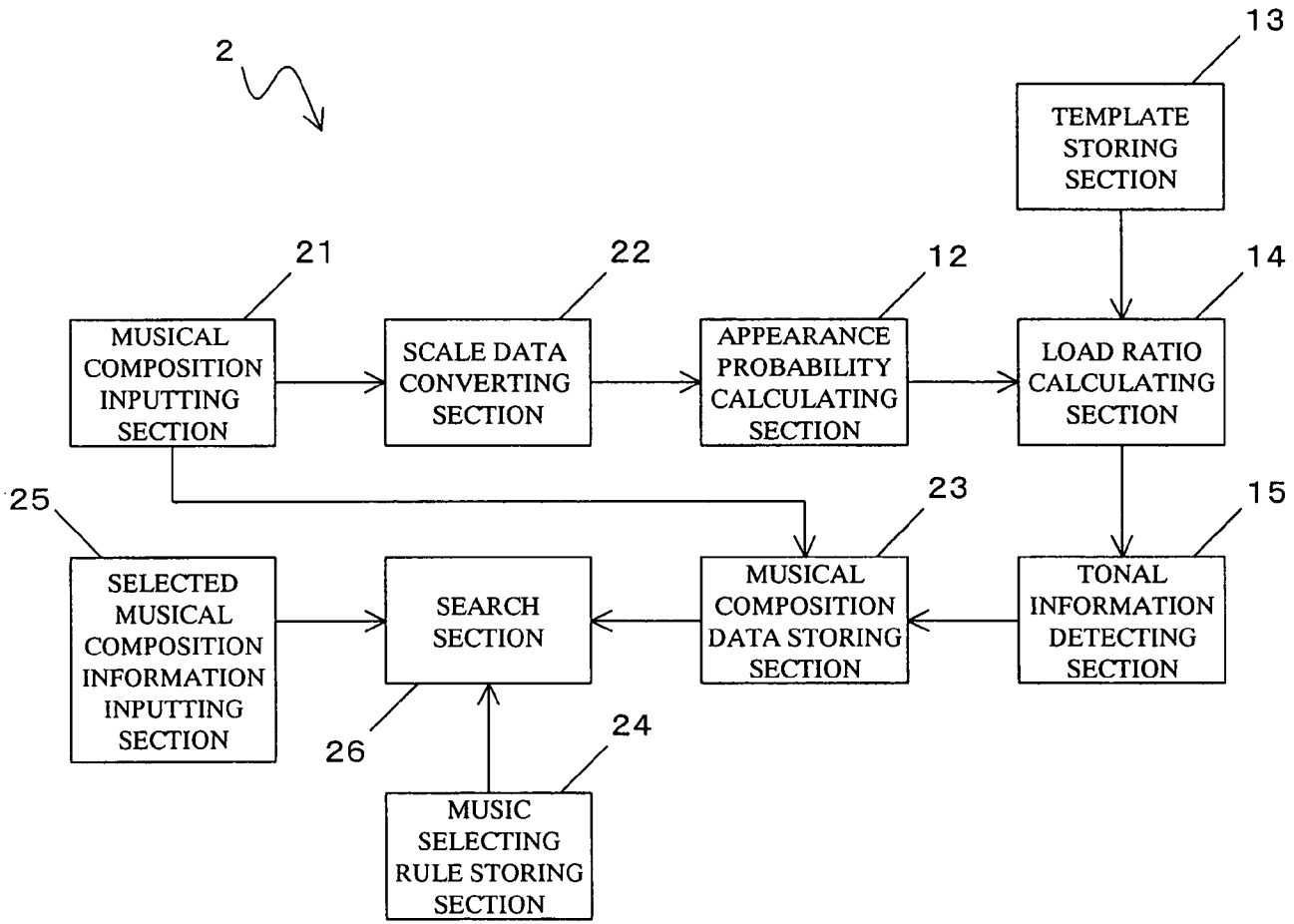

【Fig. 9】
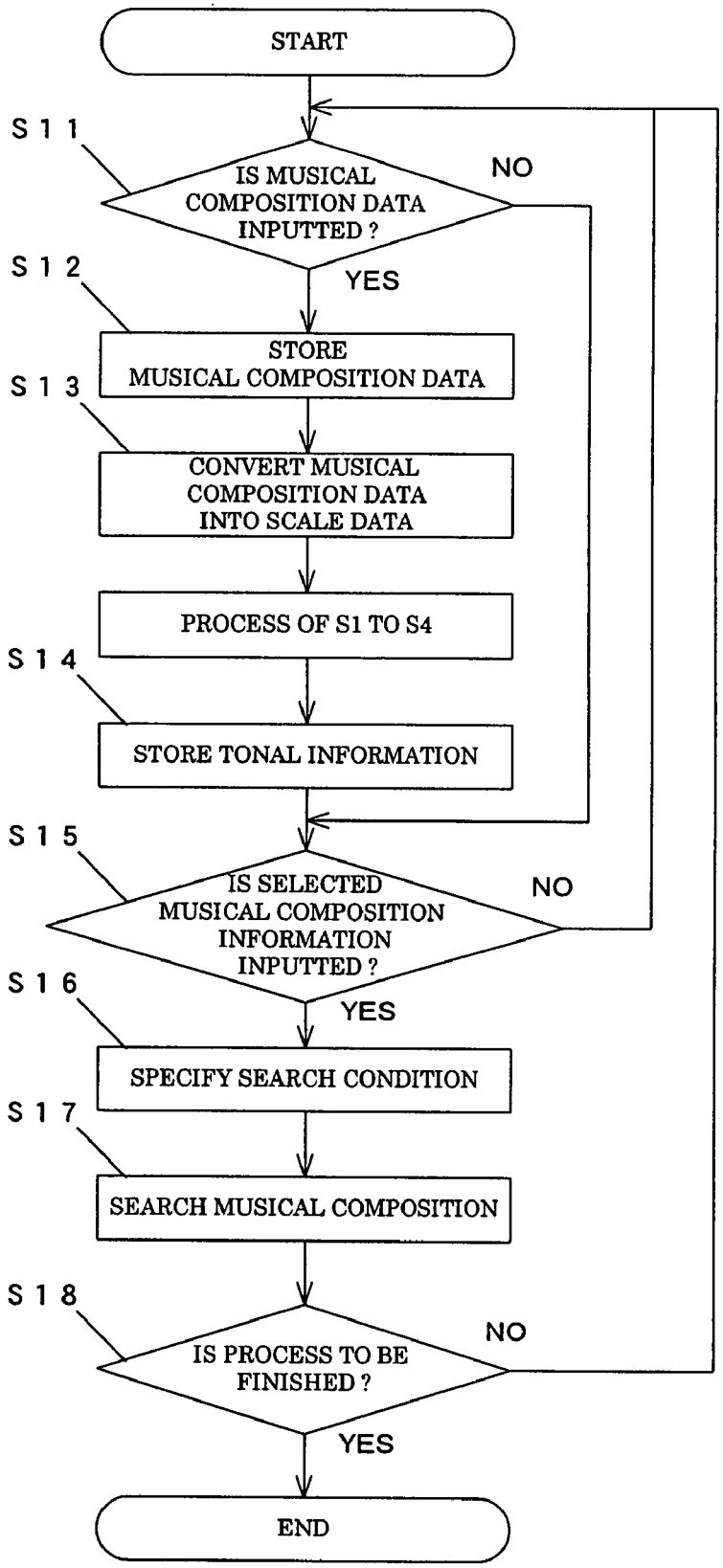

【Fig. 10】

| MUSICAL COMPOSITION NUMBER | MUSICAL COMPOSITION DATA | TONAL INFORMATION | | | |
|---|---|---|---|---|---|
| | | K | T | S | Rmaj |
| 1 | SS1.mp3 | E | Maj | 4 | 0.93 |
| 2 | SS2.wav | Dm | Min | 5 | 0.24 |
| 3 | SS3.mp3 | B ♭ | Maj | 10 | 0.76 |
| ⋮ | ⋮ | ⋮ | ⋮ | ⋮ | ⋮ |

【Fig. 11】
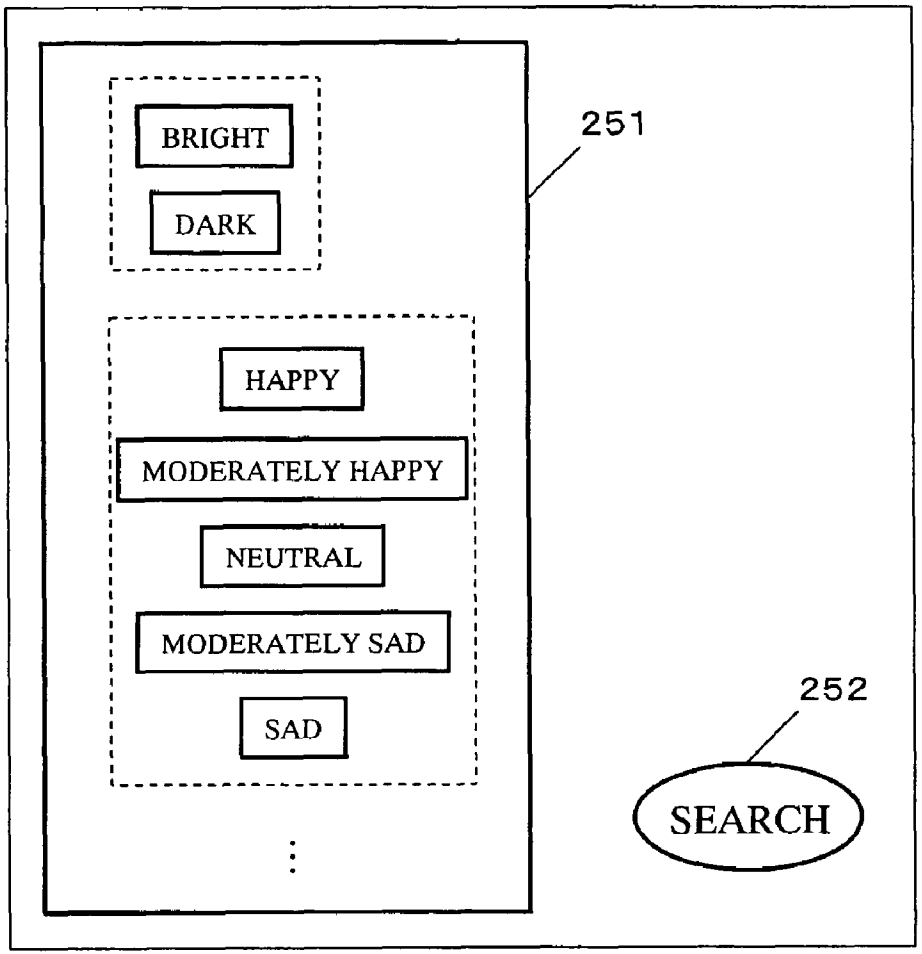

【Fig. 12】

| SELECTED MUSICAL COMPOSITION INFORMATION | SEARCH CONDITION |
|---|---|
| BRIGHT | if (T == Maj) |
| DARK | if (T == Min) |
| HAPPY | if (Rmaj > 0.8) |
| MODERATELY HAPPY | if ((Rmaj >= 0.6) && (Rmaj < 0.8)) |
| NEUTRAL | if ((Rmaj >= 0.4) && (Rmaj < 0.6)) |
| MODERATELY SAD | if ((Rmaj >= 0.2) && (Rmaj < 0.4)) |
| SAD | if (Rmaj < 0.2) |
| ⋮ | ⋮ |

MUSICAL COMPOSITION PROCESSING DEVICE

TECHNICAL FIELD

The present invention relates to a musical composition processing device, and more particularly to a musical composition processing device capable of detecting tonal information based on scale information of a musical composition, and capable of searching for a musical composition by using the tonal information.

BACKGROUND ART

In general, a method of detecting tonal information of a musical composition is known. The tonal information indicates elements which determine an image of the musical composition (a key, for example). As an exemplary method of detecting a key of a musical composition, there is a method (a first method) in which, based on information concerning a scale of a musical composition (hereinafter, referred to as scale information), appearance probabilities of pitch names included in the scale information are calculated for each of the pitch names, and a key of the musical composition is detected by using a distribution showing the appearance probabilities of the respective pitch names (referred to as an appearance probability distribution. See FIG. 3 to be described later). In this method, ideal appearance probability distributions of a plurality of types of keys are previously created and prepared respectively as templates. Then, an appearance probability distribution of a musical composition in which a key is to be detected is calculated, and the appearance probability distribution of the musical composition is compared with those represented by the templates one by one. As a result, a key, represented by one of the templates showing an appearance probability distribution most analogous to that of the musical composition, is determined as the key of the musical composition.

Also, in general, there is another method in which the scale information to be inputted is divided into predetermined segments, and a key of each of the segments is detected (see patent document 1, for example). In this method, the scale information of a musical composition is divided into a plurality of segments in such a manner as to determine first to fourth bars of the musical composition as a first segment, and second to fifth bars of the musical composition as a subsequent segment, for example. Thereafter, the key of each of the plurality of segments is detected. [patent document 1] Japanese Patent Publication No. 2715816

In reality, there maybe a musical composition composed in a plurality of types of keys such as a musical composition including a modulation. An appearance probability distribution of such a musical composition including the modulation is obtained by combining appearance probability distributions of the plurality of types of keys with each other. Therefore, the obtained appearance probability distribution may be different from any of the appearance probability distributions of the plurality of types of keys. In the first method, the appearance probability distribution of the musical composition is compared with those represented by the templates one by one. Thus, even when the appearance probability of the musical composition is obtained by combining the appearance probability distributions of the plurality of types of keys with each other, a key, represented by one of the templates showing an appearance probability distribution most analogous to the combined appearance probability distribution of the musical composition, is determined as the key of the musical composition. That is, in this case, the key determined as the key of the musical composition is different from any of keys included in the musical composition. Therefore, when the first method is used, the keys of a musical composition, composed in a plurality of types of keys such as a musical composition including a modulation, may be mistakenly detected.

Furthermore, in the method disclosed in patent document 1, the scale information of the musical composition is divided into the plurality of segments, and a key of each of the segments is detected. Then, a point at which the musical composition modulates is detected by a change in a key between each two of the segments. Note that a target portion in which a key is to be detected is not the entirety of the inputted scale information, but is each of the segments, having a short length, into which the scale information is divided. Specifically, when the method of patent document 1 is used to detect the modulation, the scale information must be divided into the segments each having a length corresponding to at least several bars (four bars, for example). However, when the scale information is divided into the plurality of segments, the number of notes included in a target portion, in which a key is to be detected, is decreased. That is, by dividing the scale information into the plurality of segments, the number of pieces of information included in the target portion, in which the key is to be detected, is decreased. Thus, an accuracy for detecting the key is necessarily reduced. As described above, in the method of patent document 1, the scale information must be divided into the plurality of segments, thereby reducing the accuracy for detecting the key of each of the segments.

Therefore, an objective of the present invention is to provide a musical composition processing device capable of accurately detecting tonal information of a musical composition, even if the musical composition includes a modulation.

SUMMARY OF THE INVENTION

A first aspect is a musical composition processing device which detects tonal information indicating a musical tone of a musical composition for a predetermined musical composition, comprising: an appearance probability acquiring section for acquiring a distribution showing appearance probabilities of respective pitch names included in at least a portion of the predetermined musical composition; a template storing section for storing templates, which are different from each other, each template corresponding a type of the musical composition and representing a distribution showing appearance probabilities of respective pitch names included in the type of the musical composition; a load ratio calculating section for calculating load ratios, each indicating a ratio of the distribution, which is represented by each of the templates stored in the template storing section, to the distribution acquired by the appearance probability acquiring section; and a tonal information detecting section for detecting, as the tonal information, a load ratio set comprised of the load ratios, corresponding to the templates, respectively, which are calculated by the load ratio calculating section.

In a second aspect based on the first aspect, the templates stored in the template storing section each represents a key of the musical composition, and are different from each other, and the tonal information detecting section further detects, as the tonal information, at least one of a key, tonality, tonality occupancy rate and scale of the predetermined musical composition, based on the load ratio set.

In a third aspect based on the second aspect, the tonal information detecting section detects, as the key of the predetermined musical composition, a key represented by one of the templates, stored in the template storing section, having a maximum load ratio calculated by the load ratio calculating section.

In a fourth aspect based on the second aspect, the tonal information detecting section executes, for each of a plurality of the templates having a same tonality, a process of calculating a total sum of the load ratios corresponding to the plurality of the templates having the same tonality, and detects a tonality of the plurality of the templates having a larger total sum as the tonality of the predetermined musical composition.

In a fifth aspect based on the second aspect, the tonal information detecting section executes, for each of a plurality of the templates having a same scale, a process of calculating a total sum of the load ratios corresponding to the plurality of the templates having the same scale, and detects a scale of the plurality of the templates having the largest total sum as the scale of the predetermined musical composition.

In a sixth aspect based on the first aspect, the musical composition processing device further comprises: a musical composition data storing section for storing a plurality of pieces of musical composition data in which the distribution showing the appearance probabilities is acquired by the appearance probability acquiring section for each of the plurality of pieces of musical composition data; a tonal information storing section for causing the musical composition data storing section to store, as the tonal information, at least one of the load ratio set detected by the tonal information detecting section and information calculated based on the load ratio set, so as to be associated with one of the plurality of pieces of musical composition data, stored in the musical composition data storing section, which corresponds to the at least one of the load ratio set and the information calculated based on the load ratio set; and a search section for searching, by using the tonal information, for at least one piece of musical composition data from among the plurality of pieces of musical composition data stored in the musical composition data storing section.

In a seventh aspect based on the sixth aspect, the musical composition processing device further comprises a musical composition selecting rule storing section for storing a musical composition selecting rule which associates selected musical composition information to be inputted by a user with a condition concerning the tonal information, wherein when the selected musical composition information is inputted by the user, the search section outputs, as a search result, the at least one piece of musical composition data, which satisfies the condition associated with the inputted selected musical composition information, from among the plurality of pieces of musical composition data stored in the musical composition data storing section.

An eighth aspect is a musical composition processing method used in a musical composition processing device which detects tonal information indicating a musical tone of a musical composition for a predetermined musical composition, wherein the musical composition processing device previously stores templates, which are different from each other, each template corresponding to a type of the musical composition and representing a distribution showing appearance probabilities of respective pitch names included in the type of the musical composition, the musical composition processing method comprising: an appearance probability acquiring step of acquiring a distribution showing appearance probabilities of respective pitch names included in at least a portion of the predetermined musical composition; a load ratio calculating step of calculating load ratios, each indicating a ratio of the distribution, which is represented by each of the templates stored in the template storing section, to the distribution acquired by the appearance probability acquiring step; and a tonal information detecting step of detecting, as the tonal information, a load ratio set comprised of the load ratios, respectively corresponding to the templates, which are calculated by the load ratio calculating step.

In a ninth aspect based on the eighth aspect, the musical composition processing device further previously stores a plurality of pieces of musical composition data in which the distribution showing the appearance probabilities is acquired by the appearance probability acquiring step for each of the plurality of pieces of musical composition data, and the musical composition processing method further comprises: a tonal information storing step of causing the musical composition processing device to store, as the tonal information, at least one of the load ratio set detected by the tonal information detecting step and information calculated based on the load ratio set, so as to be associated with one of the plurality of pieces of musical composition data stored in the musical composition processing device, which corresponds to the at least one of the load ratio set and the information calculated based on the load ratio set; and a search step of searching, by using the tonal information, for at least one piece of musical composition data from the plurality of pieces of musical composition data stored in the musical composition processing device.

A tenth aspect is a program to be executed by a computer of a musical composition processing device which detects tonal information indicating a musical tone of a musical composition for a predetermined musical composition, wherein the musical composition processing device previously stores templates, which are different from each other, each template corresponding to a type of the musical composition and representing a distribution showing appearance probabilities of respective pitch names included in the type of the musical composition, the program instructing the computer to execute: an appearance probability acquiring step of acquiring a distribution showing appearance probabilities of respective pitch names included in at least a portion of the predetermined musical composition; a load ratio calculating step of calculating load ratios, each indicating a ratio of the distribution, which is represented by each of the templates stored in the template storing section, to the distribution acquired by the appearance probability acquiring step; and a tonal information detecting step of detecting, as the tonal information, a load ratio set comprised of the load ratios, respectively corresponding to the templates, which are calculated by the load ratio calculating step.

An eleventh aspect is a computer-readable recording medium on which the program according to claim 10 is recorded.

A twelfth aspect is an integrated circuit which detects tonal information indicating a musical tone of a musical composition for a predetermined musical composition, comprising: an appearance probability acquiring section for acquiring a distribution showing appearance probabilities of respective pitch names included in at least a portion of the predetermined musical composition; a load ratio calculating section for calculating, for templates, which are different from each other, each corresponding to a type of the musical composition and representing a distribution showing appearance probabilities of respective pitch names included in the type of the musical composition, load ratios, each indicating a ratio of the distribution, which is represented by each of the templates stored in the template storing section, to the distribution acquired by the appearance probability acquiring section; and a tonal information detecting section for detecting, as the tonal information, a load ratio set comprised of the load ratios, respectively corresponding to the templates, which are calculated by the load ratio calculating section.

Effect of the Invention

According to the first aspect, instead of selecting the most analogous template from among the templates, the load ratio set comprised of the load ratios respectively corresponding to the templates is detected. Therefore, it becomes possible to recognize the ratio of an appearance probability distribution represented by each of the templates to that of the predetermined musical composition (a musical composition in which the tonal information is to be detected). In other words, instead of determining one type of a musical composition corresponding to one of the templates, "a proportion of each type occurring within the predetermined musical composition" is detected, thereby making it possible to represent a musical tone of the predetermined musical composition by means of the proportion of each type. Thus, in a case where the predetermined musical composition includes two types of keys, for example, the load ratios corresponding to the templates representing the two types of keys are calculated to be larger. That is, according to the first aspect, it becomes possible to accurately detect the tonal information of a musical composition even if the musical composition includes a modulation.

According to the second aspect, the tonal information is detected by using the load ratio set, thereby making it possible to accurately detect the most dominant key, the most dominant tonality, the most dominant tonality occupancy rate, and the most dominant scale.

According to the third aspect, the key represented by the template having the maximum load ratio is detected, thereby making it possible to accurately detect the key of the musical composition.

According to the fourth aspect, a total sum of the load ratios corresponding to the plurality of the templates having the same tonality is calculated, so as to detect a tonality of the plurality of the templates having a larger total sum, thereby making it possible to accurately detect the tonality of the musical composition.

According to the fifth aspect, a total sum of the load ratios corresponding to the plurality of the templates having the same scale is calculated, so as to detect a scale of the plurality of the templates having the largest total sum, thereby making it possible to accurately detect the scale of the musical composition.

According to the sixth aspect, it becomes possible to search for at least one musical composition by using the load ratio set or the information obtained based on the load ratio set (the key, the tonality, the scale and the like). Therefore, a search can be accurately executed by using the tonal information.

According to the seventh aspect, the user can easily search for at least one musical composition associated with the inputted selected musical composition condition.

These and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a block diagram illustrating a musical tone detecting device 1 according to a first embodiment of the present invention.

FIG. 2 a diagram illustrating exemplary scale information of a musical composition to be inputted to a scale information inputting section 11.

FIG. 3 is a diagram conceptually illustrating a distribution of appearance probabilities of respective pitch names.

FIG. 4 is a diagram illustrating an example of 24 types of templates and calculation results of load ratios respectively corresponding to the templates.

FIG. 5 is a flowchart illustrating a flow of a process executed by the musical tone detecting device 1 according to the first embodiment.

FIG. 6 is a diagram illustrating exemplary relationships between the keys forming a same scale.

FIG. 7 is a block diagram illustrating an exemplary structure in which the musical tone detecting device 1 is realized by means of a computer system 100.

FIG. 8 is a block diagram illustrating a musical composition searching device 2 according to a second embodiment of the present invention.

FIG. 9 is a flowchart illustrating a flow of a process executed by a musical composition searching device 2 according to a second embodiment.

FIG. 10 is a diagram illustrating exemplary data stored in a musical composition data storing section 23.

FIG. 11 is a diagram illustrating an exemplary input screen included in a selected musical composition information inputting section 25.

FIG. 12 is a diagram illustrating an exemplary musical composition selecting rule.

DESCRIPTION OF THE REFERENCE CHARACTERS

1 musical tone detecting device
11 scale information inputting section
12 appearance probability calculating section
13 template storing section
14 load ratio calculating section
15 tonal information detecting section
100 computer system
110 arithmetic processing section
120 storage section
130 disc drive device
140 recording medium
2 musical composition searching device
21 musical composition inputting section
22 scale data converting section
23 musical composition data storing section
24 musical composition selecting rule storing section
25 selected musical composition information inputting section
26 search section

DETAILED DESCRIPTION OF THE INVENTION

Hereinafter, embodiments of the present invention will be described with reference to the drawings. Note that in the following descriptions, a "tonality" indicates a "major" or "minor" tonality, and a "tonality occupancy rate" indicates an occupancy rate of the major (or minor) tonality in a musical composition. A "scale" indicates 12 types of combinations in the major or minor tonalities having a same key signature. A "key" indicates 24 types of keys (C; C major, Am; A minor, etc.), each consisting of the tonality and the scale. Each of the key, the tonality, the tonality occupancy rate and the scale is an index indicating a musical tone, and is one of tonal information. Note that information, indicating a set of load ratios (a load ratio set), which is to be described later, is also one of the tonal information. As an example of a musical composition processing device according to the present invention, a musical tone detecting device for detecting the tonal information will be described in a first embodiment. As another example of the musical composition processing device according to the present invention, a musical composition searching device for searching for a musical composition by using the tonal information will be described in a second embodiment.

FIRST EMBODIMENT

Firstly, a musical tone detecting device 1 according to the first embodiment of the present invention will be described with reference to FIG. 1. FIG. 1 is a block diagram illustrating the musical tone detecting device 1 according to the first embodiment of the present invention. In FIG. 1, the musical tone detecting device 1 comprises a scale information inputting section 11, an appearance probability calculating section 12, a template storing section 13, a load ratio calculating section 14, and a tonal information detecting section 15.

The scale information inputting section 11 is operable to receive an input of scale information of a musical composition from an inside or outside of the musical tone detecting device 1. The scale information of the musical composition to be inputted to the scale information inputting section 11 is data including at least information of a sound pitch (note number) and a sound length (duration). FIG. 2 is a diagram illustrating exemplary scale information of a musical composition to be inputted to the scale information inputting section 11. In FIG. 2, the scale information of the musical composition is represented by a time represented by "the number of bars/the number of beats/the number of ticks", a velocity indicating the sound length, and the note number. Note that the aforementioned time indicates a time at which a sound corresponding to the note number is audible or silent. The velocity is represented by an integer within a range of 0 to 127, and the larger the velocity is, the more increased a sound volume is. Note that a sound having the velocity of "0" is silent. The note number is set based on a pitch, of middle C on a piano keyboard, which is represented by "60". Furthermore, in FIG. 2, the duration is represented by the time and the velocity. For example, when the time indicates "000/0/000", the note number and the velocity indicate "60" and "90 (audible)", respectively. When the time indicates "000/0/432", the note number and the velocity indicate "60" and "0 (silent)", respectively. Therefore, scale information included in a time segment from "000/0/000" to "000/0/432" represents "60" as the note number, "90" as the velocity, and 432 ticks as the duration.

Note that in the exemplary scale information of the musical composition shown in FIG. 2, the time is represented by "the number of bars/the number of beats/the number of ticks". However, the time may be represented by "hours/minutes/seconds/frames/subframes". Also in FIG. 2, the velocity is represented by the integer within the range from 0 to 127. However, the velocity may be represented by two values of "1" and "0" indicating an audible sound and a silent sound, respectively, for example.

As described above, the scale information of the musical composition shown in FIG. 2 includes the sound pitch (note number) and the sound length (duration). Note that the scale information of the musical composition may be simply represented by a method including a pair of a note number and a duration corresponding to the note number. Furthermore, other than the note number and the duration, the scale information of the musical composition may be represented by another method further including pitchbend information which represents a continuous change in the note number. In this case, the note number varies in accordance with a value of pitchbend.

The appearance probability calculating section 12 calculates appearance probabilities of pitch names included in the scale information of the musical composition inputted to the scale information inputting section 11 for each of the pitch names. FIG. 3 is a diagram conceptually illustrating a distribution of the appearance probabilities of the respective pitch names (an appearance probability distribution). In FIG. 3, there are 12 types of pitch names, and a pitch name number i represented by a value from 0 to 11 is assigned to each of the 12 types of pitch names, such as C; i=0, C#; i=1 . . . B; i=11. Note that in the following descriptions, a pitch name having the pitch name number i may be described as a "pitch name i".

The template storing section 13 stores 24 types of templates corresponding to 24 types of keys, respectively. The 24 types of templates represent musical types which are different from each other. Furthermore, each of the templates shows an ideal appearance probability distribution of a key corresponding thereto. These templates are previously created and stored in the template storing section 13. FIG. 4 is a diagram illustrating an example of the 24 types of templates and calculation results of the load ratios respectively corresponding to the templates. As shown in FIG. 4, in the 24 types of keys represented by the templates, a key number j represented by a value from 0 to 11 is assigned to a major key, and the key number j represented by a value from 12 to 23 is assigned to a minor key. Note that in the following descriptions, a key having the key number j may be described as a "key j". The calculation results of the load ratios corresponding to the templates, respectively, will be described later.

Based on the appearance probability distribution, of the musical composition, which is calculated by the appearance probability calculating section 12 and each of the templates stored in the template storing section 13, the load ratio calculating section 14 calculates the load ratios corresponding to the templates, respectively (see FIG. 4). The load ratio calculating section 14 calculates 24 types of load ratios corresponding to the 24 types of templates, respectively. Note that a load ratio indicates a ratio (an occupancy rate) of the appearance probability distribution represented by each of the templates to that of the musical composition. In other words, when the appearance probability distribution of the musical composition is represented by using the 24 types of templates, the load ratio corresponding to each of the 24 types of templates is a value representing a ratio of the appearance probability distribution represented by each of the 24 types of templates to that of the musical composition. For example, if a template has a large value of the load ratio, an appearance probability distribution represented by the template occupies a large proportion of that of the musical composition. Therefore, a key corresponding to the template having the large value of the load ratio indicates a key which occupies a large proportion of the musical composition.

Based on the 24 types of load ratios calculated by the load ratio calculating section 14, the tonal information detecting section 15 detects tonal information of the musical composition. The tonal information indicates information representing a set of 24 types of load ratios (the load ratio set) or various information calculated based on the load ratio set. Note that the various information indicates information of the key, the tonality occupancy rate, the tonality and the scale, all of which are mentioned above, for example. The tonal information detecting section 15 detects the load ratio set as the tonal information. Then, the tonal information detecting section 15 also detects the key, the tonality occupancy rate, the tonality and the scale, all of which are calculated based on the load ratio set, as the tonal information.

Next, a flow of a process executed by the musical tone detecting device 1 according to the first embodiment will be described with reference to FIG. 5. FIG. 5 is a flowchart illustrating the flow of the process executed by the musical tone detecting device 1 according to the first embodiment.

The scale information inputting section 11 is operable to receive the input of the scale information of the musical composition from the inside or outside of the musical tone detecting device 1 (step S1). For example, scale data indicating the scale information such as SMF (a standard MIDI file) is inputted. Note that the scale data to be inputted may be data into which audio data such as PCM data is converted. In the present embodiment, the scale information as shown in FIG. 2 is inputted to the scale information inputting section 11. Note that in the present invention, it is unnecessary to divide the inputted musical composition into segments of bars. Thus, the scale information used in the present invention does not have to include information indicating positions of the bars. In the present invention, it is possible to accurately detect a plurality of types of keys included in a musical composition including a modulation, without dividing the musical composition into the segments of bars.

After step S1, the appearance probability calculating section 12 calculates the appearance probability of each of the pitch names included in the scale information of the musical composition inputted in step S1 (step S2). Note that an appearance probability of the pitch name i is denoted by P(i). The appearance probability P(i) is calculated by dividing a total sum of duration of the pitch name i included in the scale information by a total sum of durations of all the pitch names (i=0 to 11) included in the scale information. A total sum ΣP(i) of the appearance probability of each of the pitch names is represented by the following equation (1).

$$\Sigma P(i)=1 \ (i=0 \text{ to } 11) \tag{1}$$

As shown in step S2 mentioned above, in the present embodiment, the appearance probability calculating section 12 calculates the appearance probability distribution of each of the pitch names included in the musical composition. However, in a case where the appearance probability distribution of each of the pitch names included in the musical composition is previously known, i.e., in a case where data representing the appearance probability distribution of each of the pitch names included in the musical composition has already been acquired, the appearance probability calculating section 12 may acquire the data in step S2. In this case, a process of calculating the appearance probability distribution in step S2 can be eliminated.

After step S2, the load ratio calculating section 14 calculates the load ratio corresponding to each of the templates (step S3). The load ratio is calculated by using the appearance probability, of each of the pitch names, which is calculated in step S2 (an actual appearance probability of the musical composition) and the appearance probability, of each of the pitch names, which is represented by each of the 24 types of templates stored in the template storing section 13. Hereinafter, a method of calculating the load ratio will be described in details.

Firstly, it is assumed that an appearance probability distribution of a musical composition, in which the tonal information is to be detected, is represented by using those represented by the 24 types of templates respectively corresponding to the 24 types of keys (j=0 to 23). A load ratio, which indicates a ratio of an appearance probability distribution represented by a template of the key j to that of the musical composition in which the tonal information is to be detected, is denoted by W(j). Also, the appearance probability of the pitch name i included in the template of the key j is denoted by Pt (j, i). In this case, the following equations (2) and (3) are obtained.

$$\Sigma W(j)=1 \ (j=0 \text{ to } 23) \tag{2}$$

$$\Sigma Pt(j, i)=1 \ (i=0 \text{ to } 11) \tag{3}$$

When an appearance probability Pf(i) of the pitch name i included in scale information of the musical composition, in which the tonal information is to be detected, is represented by using the templates (i.e., by using W(j) and Pt(j, i)), the appearance probability Pf(i) is represented by the following equation (4).

$$Pf(i)=\Sigma(W(j)*Pt(j, i)) \ (j=0 \text{ to } 23) \tag{4}$$

Therefore, the load ratio W(j) (j=0 to 23) corresponding to each of the templates is calculated so that Pf(i) is equivalent to the actual appearance probability P(i) of the musical composition, which is calculated in step S2, for each of the pitch names (i=0 to 11). That is, W(j) can be obtained so as to satisfy the equations (2) to (4), and to satisfy P(i)=Pf(i) (i=0 to 11). Specifically, in the present embodiment, a sum of the square of a difference (P(i)−Pf(i)) of the appearance probability of each of the pitch names is minimized, thereby obtaining the load ratio W(j) (j=0 to 23) corresponding to each of the templates. More specifically, when a difference of the appearance probability of the pitch name i is denoted by E(i), and a sum of the square of the difference E(i) is denoted by 'E, E(i) and 'E are represented by the following equations (5) and (6), respectively.

$$E(i)=P(i)-Pf(i) \tag{5}$$

$$'E=\Sigma(E(i))^2 \ (i=0 \text{ to } 11) \tag{6}$$

By using the equation (6), the load ratio W(j) (j=0 to 23) corresponding to each of the templates is calculated so as to minimize 'E. Note that the load ratio W(j) (j=0 to 23) corresponding to each of the templates can be calculated by using an Evolutionary Strategy, for example. However, any algorithm may be used to calculate W(j). As described above, in step S3, the load ratio w(j) (j=0 to 23) corresponding to each of the templates is calculated. The load ratio W(j) (j=0 to 23) corresponding to each of the templates is represented by the calculation result as shown in FIG. 4, for example.

After step S3, the tonal information detecting section 15 detects the information indicating the set of the load ratios W(j) (j=0 to 23) respectively corresponding to the templates (the load ratio set), which are calculated in step S3, as the tonal information of the musical composition (step S4). Furthermore, in the present embodiment, in step S4, the tonal information detecting section 15 further detects the key, the tonality occupancy rate, the tonality and the scale, as the tonal information of the musical composition. Hereinafter, a method of detecting the key, the tonality occupancy rate, the tonality and the scale will be described.

Firstly, in a case of detecting the key, the tonal information detecting section 15 obtains a key of the key number j corresponding to a template having a maximum value of the load ratio W(j), thereby detecting the key as the most dominant key. In a case of detecting the tonality occupancy rate, the tonal information detecting section 15 detects, as the tonality occupancy rate, the occupancy rates of the major and minor tonalities in the musical composition by using the following method. The occupancy rate of the major tonality and the occupancy rate of the minor tonality are denoted by Rmaj and Rmin, respectively. Furthermore, in FIG. 4, the major key has the key number j (j=0 to 11), and the minor key has the key number j (j=12 to 23). Therefore, Rmaj and Rmin are calculated by the following two equations, respectively.

$$\text{Rmaj}=\Sigma W(j)(j=0 \text{ to } 11) \quad (7)$$

$$\text{Rmin}=\Sigma W(j)(j=12 \text{ to } 23) \quad (8)$$

Thus, the tonal information detecting section 15 detects, as the tonality occupancy rate, Rmaj and Rmin calculated by the equations (7) and (8), respectively.

Next, in a case of detecting the tonality, the tonal information detecting section 15 detects the tonality by determining whether the major tonality is dominant, or the minor tonality is dominant. That is, the tonal information detecting section 15 compares Rmaj calculated by the equation (7) with Rmin calculated by the equation (8). When Rmaj is larger than Rmin, the tonal information detecting section 15 detects the major tonality as the tonality. On the other hand, when Rmin is larger than Rmaj, the tonal information detecting section 15 detects the minor tonality as the tonality.

Finally, a method of detecting the scale will be described with reference to FIG. 6. FIG. 6 is a diagram illustrating exemplary relationships between the keys forming a same scale. In FIG. 6, there are 12 types of scales in total, since each of two types of keys among the 24 types of keys forms a same scale. Also, in FIG. 6, a scale number s (s=0 to 11) is assigned to each of the scales. As shown in FIG. 6, the scale number s of two types of keys of C(j=0) and Am(j=12), both forming the same scale, is 0, for example. When an occupancy rate of each of the scales included in the musical composition is denoted by a scale occupancy rate Rs(s) (s=0 to 11), Rs(s) is calculated by the following equations.

$$Rs(0)=W(0)+W(12)$$

$$Rs(1)=W(1)+W(13)$$

$$Rs(2)=W(2)+W(14)$$

$$\ldots$$

$$Rs(11)=W(11)+W(23)$$

Thus, the tonal information detecting section 15 obtains a scale of the scale number s having a maximum value of the scale occupancy rate Rs(s), thereby detecting the scale as the most dominant scale.

As described above, in the musical tone detecting device 1 according to the present invention, instead of comparing an appearance probability distribution of a musical composition with those represented by templates one by one, a ratio (load ratio), of the appearance probability distribution represented by each of the templates to the appearance probability of the musical composition, is calculated. As a result, it becomes possible to accurately detect the tonal information of the musical composition even if the musical composition is composed in a plurality of types of keys such as a musical composition including a modulation.

Furthermore, by using the load ratio set included in the tonal information of the musical composition, which is detected by the musical tone detecting device 1 according to the present embodiment, a user is allowed to understand a ratio of each of the plurality of types of keys included in the musical composition to all types of the keys included therein. That is, when a load ratio of one key is larger than those of the other keys, the user understands that the musical composition is composed in a single key type. On the other hand, when the load ratios of a great number of keys are similar to each other, the user understands that the musical composition is composed in the great number of key types. Therefore, the user is allowed to understand an image of the musical composition without actually listening to the musical composition. Furthermore, similarly to the load ratio set, by using the key, the tonality occupancy rate, the tonality and the scale, which are all included in the detected tonal information, the user is also allowed to understand the image of the musical composition without actually listening to the musical composition.

In the above descriptions, the template storing section 13 stores only one template representing each of the 24 types of keys. However, a plurality of templates representing each type of keys may be stored. In this case, the templates of different genres of musical compositions such as pops, jazz and classical music, for example, may be prepared for each type of keys, and stored in the template storing section 13. Then, a load ratio corresponding to each of the templates stored in the template storing section 13 is calculated, thereby allowing the musical tone detecting device 1 to accurately detect the tonal information corresponding to a genre of a musical composition. Furthermore, the load ratio corresponding to each of the templates includes genre information, thereby allowing the musical tone detecting device 1 to further detect a genre of the musical composition.

Alternatively, the templates of different musical parts such as melody and bass guitar, for example, may be prepared for each type of keys, and stored in the template storing section 13. Then, among all of the templates stored in the template storing section 13, load ratios corresponding to the templates of an inputted musical part are calculated, thereby allowing the musical tone detecting device 1 to accurately detect the tonal information corresponding to the inputted musical part.

Furthermore, instead of the appearance probability distributions of the 24 types of keys, the appearance probability distributions of different types of scales or chords may be used as the templates. Then, a load ratio, corresponding to each of the templates representing the appearance probability distributions of the different types of scales or chords, is calculated, thereby making it possible to detect the tonal information concerning a scale or chord.

Still furthermore, the scale information inputted to the scale information inputting section 11 includes at least one playing part such as melody or bass guitar. The scale information may include a plurality of playing parts, for example. Also, a playing time of a musical composition consisting of the scale information may be a time period for playing the entirety of the musical composition or a time period for playing a portion of the musical composition. Note that in the time period for playing the portion of the musical composition, a first half portion excluding an introduction may be played, for example. This is because the aforementioned portion of the musical composition is generally composed in a dominant key. As a result, the musical tone detecting device 1 can detect the tonal information with higher accuracy. Furthermore, a processing burden on the musical tone detecting device 1 also can be decreased.

The musical tone detecting device 1 according to the present invention may be realized by causing a general computer system 100 to execute a tonal information detecting program. FIG. 7 is a block diagram illustrating an exemplary structure in which the musical tone detecting device 1 is realized by means of the computer system 100. Note that the scale information inputting section 11, the appearance probability calculating section 12, the template storing section 13, the load ratio calculating section 14 and the tonal information detecting section 15 shown in FIG. 7 have the same functions as those shown in FIG. 1. Thus, the aforementioned components shown in FIG. 7 will be denoted by the same reference numerals as those shown in FIG. 1, and will not be further described below.

In FIG. 7, the computer system 100 comprises an arithmetic processing section 110, a storage section 120, and a disc drive device 130. The arithmetic processing section 110 is a CPU or a memory, and is operable to realize the same function as the scale information inputting section 11, the appearance probability calculating section 12, the load ratio calculating section 14, and the tonal information detecting section 15, by executing the tonal information detecting program. The storage section 120 is a recording medium such as a hard disc, and is operable to realize the same function as the template storing section 13 by executing the tonal information detecting program. The disc drive device 130 is operable to read the tonal information detecting program from the recording medium 140 storing the program for causing the computer system 100 to function as the musical tone detecting device 1. The tonal information detecting program is installed on any computer system 100, thereby making it possible to allow the computer system 100 to function as the musical tone detecting device mentioned above. Note that the recording medium 140 is a recording medium readable by the disc drive device 130 such as a flexible disc or an optical disc, for example. The tonal information detecting program may be previously installed on the computer system 100.

In the above descriptions, the tonal information detecting program is provided by the recording medium 140. However, the tonal information detecting program may be provided via an electric communication line such as the Internet. Furthermore, hardware may execute the entirety or a portion of a process of detecting the tonal information.

SECOND EMBODIMENT

Next, a musical composition searching device 2 according to the second embodiment of the present invention will be described with reference to FIGS. 8 and 9. FIG. 8 is a block diagram illustrating the musical composition searching device 2 according to the second embodiment of the present invention. In FIG. 8, the musical composition searching device 2 comprises a musical composition inputting section 21, a scale data converting section 22, the appearance probability calculating section 12, a musical composition data storing section 23, the template storing section 13, the load ratio calculating section 14, the tonal information detecting section 15, a musical composition selecting rule storing section 24, a selected musical composition information inputting section 25, and a search section 26. Note that the appearance probability calculating section 12, the template storing section 13, the load ratio calculating section 14 and the tonal information detecting section 15 shown in FIG. 8 have the same functions as the respective components of the musical tone detecting device 1 described in the first embodiment. Thus, the aforementioned components shown in FIG. 8 will be denoted by the same reference numerals as those of the first embodiment, and will not be further described below.

FIG. 9 is a flowchart illustrating a flow of a process executed by the musical composition searching device 2 according to the second embodiment. Note that steps S1 to S4 in FIG. 9 are the same process as steps S1 to S4 executed by the musical tone detecting device 1 described in the first embodiment (see FIG. 5). Thus, the aforementioned steps in FIG. 9 will be denoted by the same reference numerals as those of the first embodiment, and will not be further described below. Hereinafter, the process of the flow executed by the musical composition searching device 2 will be described with reference to FIG. 9.

The musical composition inputting section 21 determines whether or not musical composition data is inputted from an inside or outside of the musical composition searching device 2 (step S11). As a result of the determination in step S11, when the musical composition data is not inputted, a process of step S15 is executed. On the other hand, as a result of the determination in step S11, when the musical composition data is inputted, a process of step S12 is executed. That is, the musical composition inputting section 21 causes the musical composition data storing section 23 to store the inputted musical composition data (step S12).

In the present embodiment, the musical composition data may be audio data or scale data. The audio data is PCM audio data, or compressed audio data such as MP3 and AAC, for example. The scale data indicates scale information such as SMF (standard MIDI file), for example. Note that the inputted musical composition data includes at least one playing part such as melody or bass guitar. The inputted musical composition data may include a plurality of playing parts, for example. Furthermore, a playing time of the musical composition data may be a time period for playing the entirety of the musical composition data or a time period for playing a portion of the musical composition data.

After step S12, when the musical composition data stored in step S12 is audio data (PCM audio data, for example), the scale data converting section 22 converts the audio data into scale data indicating the scale information (step S13). The scale data converting section 22 converts the audio data into the scale data by using a method disclosed in Japanese Laid-Open Patent Publication No. 58-181090, for example. When the audio data is compressed audio data such as MP3 and AAC, the scale data converting section 22 firstly converts the audio data into PCM audio data, and then converts the PCM audio data into scale data. Note that a method of converting the audio data into the scale data is not limited to that mentioned above. Other methods may be used to convert the audio data into the scale data. Alternatively, when the musical composition data stored in step S12 is scale data such as SMF, the process of steps S1 to S4 is executed without executing a process of step S13 mentioned above.

After step S13, by executing steps S1 to S4 (see FIG. 5), tonal information is detected based on the scale data stored in step S12 or the scale data converted in step S13. Then, the tonal information detecting section 15 causes the musical composition data storing section 23 to store the tonal information (step S14). In the present embodiment, the musical composition data storing section 23 stores the musical composition data stored in step S12 and the tonal information, of the musical composition data, detected in step S4, so as to associate with each other. FIG. 10 is a diagram illustrating exemplary data stored in the musical composition data storing section 23. As shown in FIG. 10, other then the musical composition data, the musical composition data storing section 23 stores, as the tonal information, the most dominant key (K), the tonality (T), the most dominant scale (S) and the occupancy rate of the major tonality (Rmaj). In FIG. 10, the most dominant scale (S) of the musical composition data is represented by the scale numbers. Furthermore, as shown in FIG. 10, a plurality of pieces of musical composition data, stored in the musical composition data storing section 23, are managed by musical composition numbers each assigned thereto. Therefore, a piece of musical composition data and a piece of tonal information associated therewith can be added or deleted, when necessary.

In step S14, the musical composition data storing section 23 stores at least one of the load ratio set, the key, the tonality occupancy rate, the tonality and the scale, which are all included in the tonal information detected in step S4.

After step S14, the search section 26 determines whether or not selected musical composition information is inputted from the selected musical composition information inputting section 25 (step S15). The user operates the selected musical composition information inputting section 25 so as to input the selected musical composition information of a desired musical composition. FIG. 11 is a diagram illustrating an exemplary input screen included in the musical composition searching device 2. As shown in FIG. 11, a selected musical composition information list 251 and a search button 252 are displayed on the input screen. The user operates the selected musical composition information inputting section 25 so as to select a desired piece of selected musical composition information from among pieces of selected musical composition information included in the selected musical composition information list 251. Thereafter, the user pushes the search button 252, thereby inputting the piece of selected musical composition information.

As a result of the determination in step S15, when the selected musical composition information is not inputted, the process returns to step S11. On the other hand, as the result of the determination in step S15, when the selected musical composition information is inputted, a process of step S16 is executed.

After step S15, the search section 26 specifies a search condition corresponding to the selected musical composition information inputted (step S16). In the present embodiment, as a method of specifying a search condition corresponding to an inputted piece of selected musical composition information, there is a method of specifying the search condition based on a musical composition selecting rule stored in the musical composition selecting rule storing section 24. FIG. 12 is a diagram illustrating an exemplary musical composition selecting rule. The musical composition selecting rule storing section 24 stores the musical composition selecting rule which is used for searching for a musical composition. In FIG. 12, the pieces of the selected musical composition information displayed in the selected musical composition information list 251 and the search conditions corresponding to the pieces of selected musical composition information, respectively, are previously set as the musical composition selecting rule. Specifically, in FIG. 12, a search condition corresponding to a piece of selected musical composition information indicating "bright" is set so as to search for musical composition data having the major tonality, and a search condition corresponding to another piece of selected musical composition information indicating "moderately happy" is set so as to search for musical composition data having the occupancy rate of the major tonality Rmaj of 0.6 to 0.8, for example.

Note that the pieces of selected musical composition information stored in the musical composition selecting rule storing section 24 may be classified in accordance with a level of "happy<->sad", instead of classifying the pieces of selected musical composition information into five levels of "happy", "moderately happy", "neutral", "moderately sad" and "sad", for example. In this case, as the selected musical composition information, a level sx of "happy (1.0)<->sad (0.0)" is set, for example. Also, as the search condition, musical composition data, in which a difference between the occupancy rate of the major tonality Rmaj and the level sx is 0.1 or less, is set, for example. The user uses a slider bar as the selected musical composition information inputting section 25, for example, to input a piece of selected musical composition information.

After step S16, based on the search condition specified in step S16, the search section 26 searches for a musical composition from the pieces of musical composition data stored, in step S12, in the musical composition data storing section 23, and displays a title of the musical composition satisfying the search condition (step S17). Note that in step S17, a process of reproducing the displayed title of the musical composition may be further executed.

In the above descriptions, the user inputs the selected musical composition information, thereby specifying the search condition used for searching for a musical composition. In another embodiment, the user may directly input the search condition, and specify the inputted search condition. For example, the user operates the selected musical composition information inputting section 25 so as to input a condition indicating "key is C" or "major tonality" or a compound condition obtained by combining a plurality of such conditions. Then, by using the tonal information stored in the musical composition data storing section 23, the search section 26 searches for a musical composition satisfying the search condition inputted by the user, and displays a title of the musical composition satisfying the search condition. As a result, instead of using the search condition specified in accordance with the musical composition selecting rule which is previously set, the user is allowed to search for a musical composition by inputting the search condition freely.

After step S17, the user selects whether or not to finish the process executed by the musical composition searching device 2 (step S18). In a case where the process is not to be finished, the process returns to step S11. The aforementioned process is executed on each of the plurality of pieces of musical composition data inputted.

As described above, the musical composition searching device 2 according to the present embodiment allows the user to search for a musical composition based on the tonal information of the musical composition.

The musical composition processing device (the musical tone detecting device 1 and the musical composition searching device 2) described in the first and second embodiments may be formed by an integrated circuit. For example, in the first embodiment, the appearance probability calculating section 12, the load ratio calculating section 14, and the tonal information detecting section 15 may be formed by an integrated circuit. In this case, the integrated circuit includes an input terminal for inputting the musical composition and the templates stored in the template storing section 13, and an output terminal for outputting the tonal information detected by the tonal information detecting section 15. Also, in the second embodiment, the appearance probability calculating section 12, the load ratio calculating section 14, the tonal information detecting section 15, the scale data converting section 22, and the search section 26 may be formed by an integrated circuit. In this case, the integrated circuit includes an input terminal for inputting the musical composition, the templates stored in the template storing section 13, the musical composition selecting rule, the selected musical composition information, the musical composition data stored in the musical composition data storing section 23, and the tonal information stored in the musical composition data storing section 23. Furthermore, the integrated circuit also includes an output terminal for outputting the tonal information detected by the tonal information detecting section 15 and a search result obtained by the search section 26. If an integrated circuit includes a storage section, components for storing data or the like (the template storing section 13, for example) may be formed as a portion of the integrated circuit by causing the storage section to store the data, when necessary.

While the invention has been described in detail, the foregoing description is in all aspects illustrative and not restrictive. It is understood that numerous other modifications and variations can be devised without departing from the scope of the invention.

INDUSTRIAL APPLICABILITY

A musical composition processing device according to the present invention is applicable to a musical composition searching device, a jukebox, an audio player, and the like, which perform a search for a musical composition by using detected tonal information.

The invention claimed is:

1. A musical composition processing device which detects tonal information indicating a musical tone of a musical composition for a predetermined musical composition, comprising:

an appearance probability acquiring section for acquiring a distribution showing appearance probabilities of respective pitch names included in at least a portion of the predetermined musical composition;

a template storing section for storing templates, which are different from each other, each template corresponding to a type of the musical composition and representing a distribution showing appearance probabilities of respective pitch names included in the type of the musical composition;

a load ratio calculating section for calculating load ratios, each indicating a ratio of the distribution, which is represented by each of the templates stored in the template storing section, to the distribution acquired by the appearance probability acquiring section; and a tonal information detecting section for detecting, as the tonal information, a load ratio set comprised of the load ratios, respectively corresponding to the templates, which are calculated by the load ratio calculating section.

2. The musical composition processing device according to claim 1, wherein the templates stored in the template storing section each represents a key of musical composition, and are different from each other, and the tonal information detecting section further detects, as the tonal information, at least one of a key, tonality, tonality occupancy rate and scale of the predetermined musical composition, based on the load ratio set.

3. The musical composition processing device according to claim 2, wherein the tonal information detecting section detects, as the key of the predetermined musical composition, a key represented by one of the templates, stored in the template storing section, having a maximum load ratio calculated by the load ratio calculating section.

4. The musical composition processing device according to claim 2, wherein the tonal information detecting section executes, for each of a plurality of the templates having a same tonality, a process of calculating a total sum of the load ratios corresponding to the plurality of the templates having the same tonality, and detects a tonality of the plurality of the templates having a larger total sum as the tonality of the predetermined musical composition.

5. The musical composition processing device according to claim 2, wherein the tonal information detecting section executes, for each of a plurality of the templates having a same scale, a process of calculating a total sum of the load ratios corresponding to the plurality of the templates having the same scale, and detects a scale of the plurality of the templates having the largest total sum as the scale of the predetermined musical composition.

6. The musical composition processing device according to claim 1, further comprising:

a musical composition data storing section for storing a plurality of pieces of musical composition data in which the distribution showing the appearance probabilities is acquired by the appearance probability acquiring section for each of the plurality of pieces of musical composition data;

a tonal information storing section for causing the musical composition data storing section to store, as the tonal information, at least one of the load ratio set detected by the tonal information detecting section and information calculated based on the load ratio set, so as to be associated with one of the plurality of pieces of musical composition data, stored in the musical composition data storing section, which corresponds to the at least one of the load ratio set and the information calculated based on the load ratio set; and a search section for searching, by using the tonal information, for at least one piece of musical composition data from among the plurality of pieces of musical composition data stored in the musical composition data storing section.

7. The musical composition processing device according to claim 6, further comprising a musical composition selecting rule storing section for storing a musical composition selecting rule which associates selected musical composition information to be inputted by a user with a condition concerning the tonal information, wherein when the selected musical composition information is inputted by the user, the search section outputs, as a search result, the at least one piece of musical composition data, which satisfies the condition associated with the inputted selected musical composition information, from among the plurality of pieces of musical composition data stored in the musical composition data storing section.

8. A musical composition processing method used in a musical composition processing device which detects tonal information indicating a musical tone of a musical composition for a predetermined musical composition, wherein the musical composition processing device previously stores templates, which are different from each other, each template corresponding to a type of the musical composition and representing a distribution showing appearance probabilities of respective pitch names included in the type of the musical composition, the musical composition processing method comprising:

an appearance probability acquiring step of acquiring a distribution showing appearance probabilities of respective pitch names included in at least a portion of the predetermined musical composition;

a load ratio calculating step of calculating load ratios, each indicating a ratio of the distribution, which is represented by each of the templates stored in the template storing section, to the distribution acquired by the appearance probability acquiring step; and a tonal information detecting step of detecting, as the tonal information, a load ratio set comprised of the load ratios, respectively corresponding to the templates, which are calculated by the load ratio calculating step.

9. The musical composition processing method according to claim 8, wherein the musical composition processing device further previously stores a plurality of pieces of musical composition data in which the distribution showing the appearance probabilities is acquired by the appearance probability acquiring step for each of the plurality of pieces of musical composition data, the musical composition processing method further comprising:

a tonal information storing step of causing the musical composition processing device to store, as the tonal information, at least one of the load ratio set detected by the tonal information detecting step and information calculated based on the load ratio set, so as to be associated with one of the plurality of pieces of musical composition data stored in the musical composition processing device, which corresponds to the at least one of the load ratio set and the information calculated based on the load ratio set; and a search step of searching, by using the tonal information, for at least one piece of musical composition data from the plurality of pieces of musical composition data stored in the musical composition processing device.

10. A program stored on a computer-readable medium and executed by a computer of a musical composition processing device which detects tonal information indicating a musical tone of a musical composition for a predetermined musical composition, wherein the musical composition processing device previously stores templates, which are different from each other, each template corresponding to a type of the musical composition and representing a distribution showing appearance probabilities of respective pitch names included in the type of the musical composition, the program causing the computer to execute:

an appearance probability acquiring step of acquiring a distribution showing appearance probabilities of respective pitch names included in at least a portion of the predetermined musical composition;

a load ratio calculating step of calculating load ratios, each indicating a ratio of the distribution, which is represented by each of the templates stored in the template storing section, to the distribution acquired by the appearance probability acquiring step; and a tonal information detecting step of detecting, as the tonal information, a load ratio set comprised of the load ratios, respectively corresponding to the templates, which are calculated by the load ratio calculating step.

11. A computer-readable recording medium on which the program according to claim 10 is recorded.

12. An integrated circuit which detects tonal information indicating a musical tone of a musical composition for a predetermined musical composition, comprising:

an appearance probability acquiring section for acquiring a distribution showing appearance probabilities of respective pitch names included in at least a portion of the predetermined musical composition;

a load ratio calculating section for calculating, for templates, which are different from each other, each template corresponding to a type of the musical composition and representing a distribution showing appearance probabilities of respective pitch names included in the type of the musical composition, load ratios, each indicating a ratio of the distribution, which is represented by each of the templates stored in the template storing section, to the distribution acquired by the appearance probability acquiring section; and a tonal information detecting section for detecting, as the tonal information, a load ratio set comprised of the load ratios, respectively corresponding to the templates, which are calculated by the load ratio calculating section.

* * * * *